US005207972A

United States Patent [19]

Hemsath

[11] Patent Number: 5,207,972

[45] Date of Patent: May 4, 1993

[54] HIGH TEMPERATURE FURNACE

[75] Inventor: Klaus H. Hemsath, Toledo, Ohio

[73] Assignee: Indugas, Inc., Toledo, Ohio

[21] Appl. No.: 805,580

[22] Filed: Dec. 10, 1991

Related U.S. Application Data

[63] Continuation-in-part of Ser. No. 520,244, May 7, 1990, Pat. No. 5,078,368.

[51] Int. Cl.[5] ..... F27B 9/16

[52] U.S. Cl. ..... 266/44; 266/262; 432/138

[58] Field of Search ..... 266/236, 262, 252, 44; 432/138, 11, 121; 165/2

[56] References Cited

U.S. PATENT DOCUMENTS

| | | | |
|---|---|---|---|
| 3,782,883 | 1/1974 | Nesbitt et al. | 431/185 |
| 3,819,323 | 6/1974 | Hemsath et al. | 432/138 |
| 3,836,320 | 9/1974 | Hemsath et al. | 432/11 |
| 5,052,921 | 10/1991 | Hemsath | 432/121 |

OTHER PUBLICATIONS

"40th Anniversay of Research at IJmuiden", International Flame Research Foundation, Dec. 1989.

"Research at IJmuiden During the Triennial 1989-1991", Int'l Flame Research Foundation, Dec. 1989.

*Primary Examiner*—Scott Kastler

*Attorney, Agent, or Firm*—Body, Vickers & Daniels

[57] ABSTRACT

A high temperature, low $NO_x$ industrial furnace coal-fired burners placed in an arcuate heat track conduit which heats an arcuately configured wall member extending through an opening in the heat track conduit. The heated portion of the wall member rotates out of the heat track conduit to indirectly heat a bundle or bank of heat exchange tubes while an unheated wall portion moves into the opening vacated by the heated wall portion. The regenerative heated wall member thus permits the heat exchange tube bundle to be heated to high temperature without exposure to the burner products of combustion. The coal-fired burners are operated substoichiometrically to produce combustibles and a free-standing, jet entrainment arrangement is utilized to achieve staged combustion to avoid $NO_x$ formation.

12 Claims, 2 Drawing Sheets

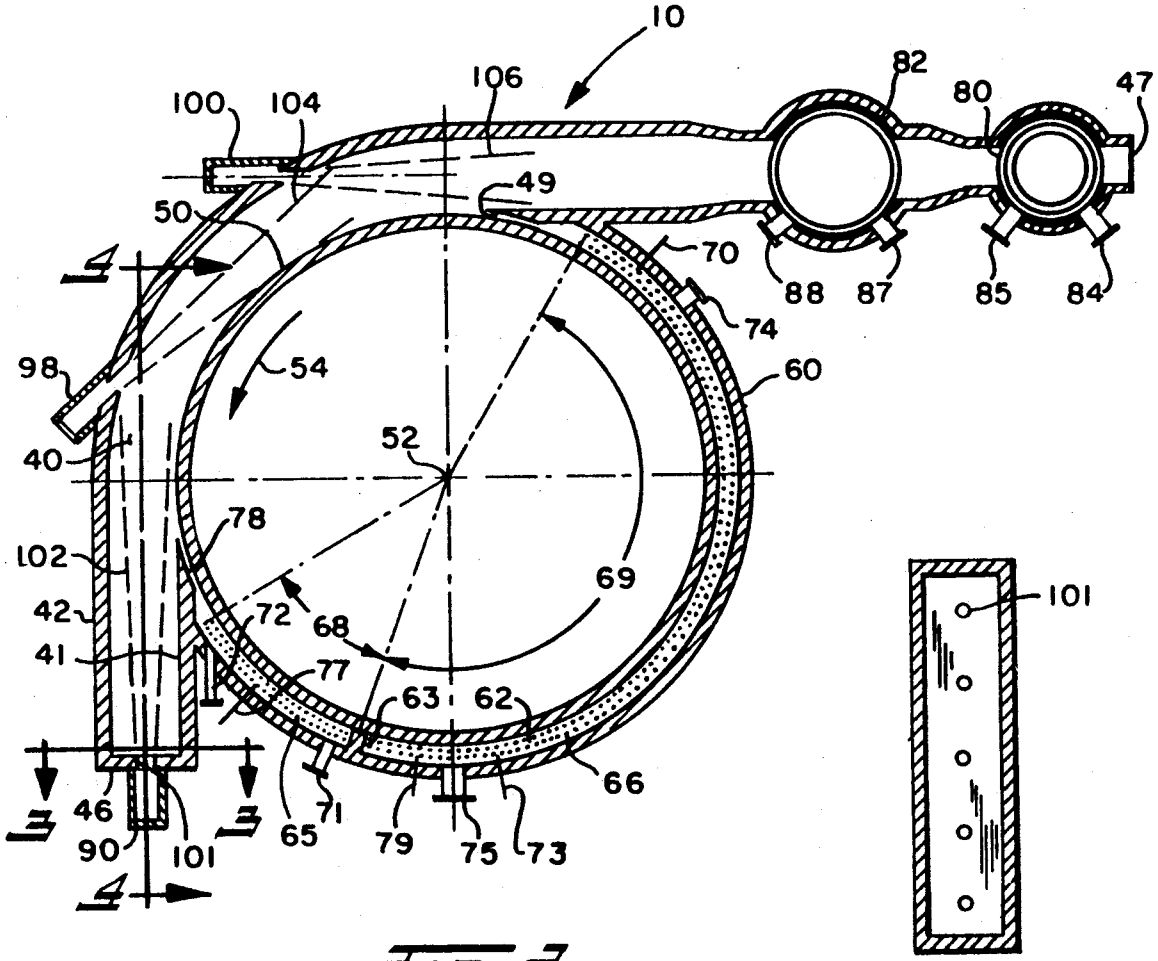
FIG. 2
FIG. 3
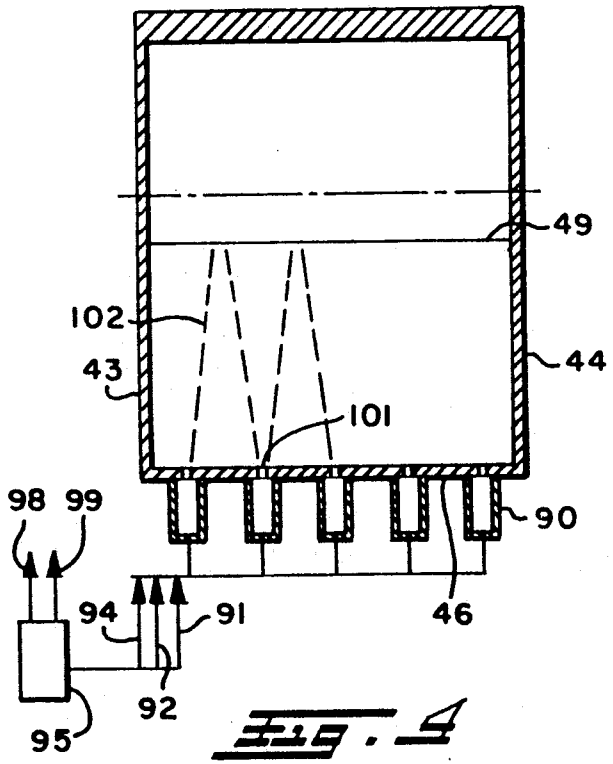
FIG. 5

HIGH TEMPERATURE FURNACE

This is a Continuation-In-Part of my co-pending patent application Ser. No. 520,244 filed May 7, 1990 now U.S. Patent No. 5.078,368.

This invention relates generally to a high temperature industrial furnace and more particularly to a high temperature, coal-fired furnace for boiler applications having low $NO_x$ products of combustion.

The invention is particularly applicable to and will be described with specific reference to a coal-fired, electric generating facility. However, the invention has many applications apart from its use in an electrical generating power plant and specifically, its contemplated uses and applications include heat exchangers whether of the air-to-air or air-to-liquid type coal fired industrial boilers, and generally, coal-fired furnaces for carrying out any industrial heat process.

INCORPORATION BY REFERENCE

Incorporated herein and made a part hereof is my pending application entitled "Gas Fired Melting Furnace" Ser. No. 520,244 filed May 7, 1990 now United States patent 5,078,368.

Also incorporated by reference herein and made a part hereof is my U.S. Pat. No. 3,819,323 dated Jun. 25, 1974 and my U.S. Pat. No. 5,052,921 dated Oct. 1, 1991. My other patents, while in somewhat unrelated art are incorporated herein so that the specifications hereof need not discuss in detail concepts, theories and apparatus utilized in some respects herein but discussed and disclosed in detail in the aforementioned documents.

BACKGROUND

The United States Department of Energy's Pittsburgh Energy Technology Center has proposed a program entitled "Engineering Development of Coal-Fired High Performance Power Generation System" (DOE PRDA No. DE-RA22-90PC90159). In this system a combined Brayton-Rankine cycle is used to generate electricity. FIG. 1 of this patent application discloses a schematic of the DOE gas turbine cycle. In that cycle disclosed in FIG. 1, a high temperature furnace is required to generate steam and air to drive the combined Brayton-Rankine cycle. This invention includes a furnace which can be used in the cycle but was conceived and developed without DOE funding and the United States government acquires no rights in/or to this invention. However the cycle is background to this invention.

With respect to coal-fired boilers, it is known to position a plurality of coal-fired burners in a wall so that the burners develop a two dimensional array or matrix of flame fronts which impinge upon a plurality of heat exchanger tubes extending through the boiler. Carbon and/or ash from the coal eventually coat the heat exchanger tubes making them less effective and materially shortening their life. That is, not only does the coating interfere with heat transfer to the tube, but the coating chemically reacts with the tube to cause disintegration of the tube. In addition, it is known that the maximum tensile and ultimate stresses of alloy tubes are significantly reduced when temperature increases from 1100–1200° F. to 1600–1800° F. The stress reduction at elevated temperature becomes further aggravated when ash coats the tube, thus rendering conventional alloy heat exchange tubes unsuitable for high temperature applications in sooty, coal combustion atmospheres. To some extent the adverse effects of the coating are reduced by periodically purging high velocity gas or air flow followed by boiler cleaning of loose carbon and/or ash particles. While purging may alleviate the problem in conventional low temperature boiler applications, in high temperature application, the carbon or ash coats or fuses itself to the heat exchanger tubes and cannot be dissipated by the purge cycles.

In addition, prior art, coal-fired boilers do not operate at the temperatures discussed herein and produce $NO_x$ during combustion at emission levels far surpassing proposed and now existing $NO_x$ emission levels. Such emission levels have required conversion of coal-fired burners to natural gas or other forms of energy. With respect to $NO_x$ emissions from coal-fired burners per se, research work on staged combustion with pulverized coal burners conducted by the International Flame Research Foundation has demonstrated that pulverized coal burners with staged combustion can produce low $NO_x$ emissions and that such burners could be retrofitted to water-tube boilers. That is, it is known to use the staged combustion approach to limit the upper flame temperature of the coal fired burner to keep $NO_x$ emissions low. However, the staged combustion approaches typically used in the prior art either are ineffective to limit the temperatures to the desired ranges or produce localized hot spots or temperature spikes whereat $NO_x$ compounds form.

The prior art clustered burners used in boilers blends or molds the burner flames together into one large flame mass which limits the ability of such arrangement to effect uniform heat transfer by radiation. At high temperatures, it is known that heat transfer principally occurs by radiation. The cluster prior art boilers cannot and do not present a "transparent" flame. The massive flame front serves as a radiation front driving temperatures to excessively high levels at certain areas of the heat exchange tubes which "see" the flame front. This not only distorts heat transfer uniformity and eventually thermally destroys the tubes but significantly contributes to high $NO_x$ formation levels.

SUMMARY OF THE INVENTION

It is thus a principal object of the present invention to provide a high temperature furnace which overcomes the deficiencies of prior art boilers discussed above.

This object along with other features of the invention is achieved in an industrial furnace for indirectly heating fluids to high temperatures which furnace includes a ceramic furnace casing having an elongated heat track conduit section and a cylindrical wall section adjacent to the heat track conduit section. The heat track conduit section has an arcuately shaped outer wall and an inner heat track wall adjacent to the cylindrical wall section and spaced from the outer wall with an opening formed therein. The heat track conduit section also has an inlet end and an outlet end. The cylindrical wall section is defined by an arcuate wall circumferentially extending a predetermined arcuate distance and terminating generally adjacent the inner heat track wall. A ceramic, longitudinally extending heat transfer cylinder is disposed within the cylindrical outer wall section and has a portion of its cylindrical, circumferential surface extending into the opening thus forming or comprising a portion of the heat track conduit. The heat transfer cylinder has a second cylindrical, circumferential surface portion disposed within and spaced radially inwardly from the outer cylindrical wall to define an annular heat transfer space therebetween and a plurality of heat exchange tubes carrying a fluid medium to be heated is positioned within the annular heat transfer space. A burner arrangement is provided at the inlet end of the heat track conduit section to heat that portion of the heat transfer cylinder extending into the opening of the inner heat track wall. A mechanism is provided to rotate the heat transfer cylinder so that the first surface portion thereof, initially in the opening, rotates to a position adjacent the cylindrical outer wall for heating the heat exchange tubes principally by radiation while the second surface portion of the heat transfer cylinder initially adjacent the cylindrical wall section, rotates into the opening of the inner heat track wall to in turn be heated by the burner arrangement whereby the heat exchange tubes are indirectly heated by the heat transfer cylinder.

In accordance with a specific feature of the invention, the burners used in the furnace combust pulverized coal and combustion air to produce a sooty atmosphere within the heat track conduit which eventually forms ash. The inner track wall's opening has a pair of longitudinally extending edge openings positioned closely adjacent to that portion of the surface of the heat transfer cylinder which extends into the opening thus defining a pair of longitudinally extending orificing slot openings therebetween. A mechanism is provided for pressuring the annular heat transfer space to prevent the sooty burner atmosphere from entering the annular heat transfer space so that the heat exchanger tubes within the annular space are not exposed to the deleterious effects of the sooty atmosphere and can be constructed of conventional steel alloy material.

In accordance with an important aspect of the invention, the furnace also includes a mechanism to control the ratio of coal and combustion air emitted to the burner to produce substoichiometric combustion at a fuel to air ratio which produces combustibles such as $H_2$ and CO at a sufficiently high percentage of the products of combustion to maintain the flame temperature of the burner less than 3,000° F. whereby formation of $NO_x$ compounds are minimized. The ratio control mechanism is effective to generate a free-standing jet of products of combustion emanating from the burner and the jet stream conically expands into tangential contact with a portion of the surface of the heat transfer cylinder which extends through the opening for effective heat transfer contact therewith. The furnace further includes a completion air mechanism for directing a freely expanding jet stream of completion air through the outer track wall for staged combustion of the combustibles and the completion air mechanism regulates jet velocity and entrainment while metering combustion air to prevent the combustibles from raising the temperature of the products of combustion to temperature in excess of 3,000° F. to minimize formation of $NO_x$ and localized high temperature areas whereat $NO_x$ formation can occur. Specifically, the completion air mechanism includes an air jet nozzle orientated to produce a jet stream which freely expands into tangential contact with that surface portion of the heat transfer cylinder which extends into the opening thus minimizing turbulence of the burner products of combustion which could raise the temperature of the burner gases to that whereat $NO_x$ formation occurs while simultaneously, effecting convective heat transfer between jet stream and heat transfer cylinder. Importantly, by providing a plurality of completion air jet streams, the straight line path of the products of combustion is curved about the arcuate heat track conduit thus producing an effective, long length jet path where entrainment and controlled mixing of combustibles and air occurs.

In accordance with another important aspect of the invention the heat track conduit includes a straight leg portion adjacent to its closed end wall and generally tangential to that surface portion of the heat transfer cylinder extending within the opening. The burner means is effective to produce a burner flame totally contained within the straight leg portion to prevent radiation from the burner flame heating the heat transfer cylinder to temperatures in excess of 3,000° F. whereat $NO_x$ compounds may be formed.

In accordance with another aspect of the invention a method is provided for effecting high temperature heat transfer in an industrial furnace system having a heat track conduit with an opening in its inner wall, a heat transfer cylinder positioned relative to the heat track conduit so that a portion of its cylindrical surface extends through the opening, and a cylindrical furnace casing wall extending about that portion of the heat transfer surface which does not extend into the opening to define an annular heat transfer space between the casing wall and the heat transfer cylinder wherein a plurality of heat exchange tubes are positioned. The method includes the steps of providing industrial burners in the heat track conduit and firing the burners to produce burner products of combustion at high temperature; heating that portion of the cylindrical surface of the heat transfer cylinder which extends into the opening from the burner's products of combustion; rotating the heat transfer cylinder so that the heat transfer cylinder's surface portion which is heated is rotated into the heat transfer space; heating the heat exchange tubes in the annular space from the heated cylindrical surface portion of the heat transfer cylinder while simultaneously cooling that cylindrical portion as heat is transferred to the heat exchanger tubes, and rotating the cylindrical surface portion when cooled by heat transferred to the heat exchange tubes back into the opening for reheating by the burner products of combustion so that a continuous, regenerative furnace system is provided for indirectly heating fluid in the heat exchange tubes. The heat transfer cylinder may be continuously or intermittently rotated. The space between the heat track conduit opening and the surface of heat transfer cylinder is closely controlled to function as an orifice with the annular heat transfer space optimally provided with an inlet and an outlet so that a fluid such as air can be supplied to the annular heat transfer space with the orificing arrangement functioning to pressurize the fluid in the annular heat transfer space to a higher pressure than that which exists in the heat track conduit thus preventing burner products of combustion from entering the annular heat transfer space while also permitting heat transfer from the surface of the heat transfer cylinder to the heat exchanger tubes to occur by convection as well as by radiation.

In accordance with an important aspect of the method of the invention, the burners, which are coal-fired, are controlled in the ratio of fuel to primary combustion air to produce products of combustion which are rich in combustibles such that the adiabatic flame temperature of the burners do not exceed about 3,000° F. Specifically the method includes the step of firing the burners to produce a stream of primary air and fuel (preferably pulverized coal) which stream is positioned within a jet annulus of secondary completion air which jet annulus is preferably a conical, right angle, free standing jet that entrains and carries the burner's products of combustion while the jet expands radially into tangential impingement contact with that cylindrical surface portion of the heat transfer cylinder which extends into the heat track conduit opening to avoid turbulence and localized high temperatures tending to produce $NO_x$ formations. More specifically the invention further contemplates directing a preheated tertiary air jet downstream of the secondary air jet to tangentially impinge a portion of the surface of the heat transfer cylinder extending within the opening and controlling the rate of completion air flow within the tertiary jet and the velocity of the jet to permit controlled entrainment of the burner combustibles and the products of combustion such that the temperature of the tertiary air jet stream does not rise above 3,000° F. Still yet further, a plurality of the coal-fired burners are longitudinally spaced along the end wall and in alignment with one another and the secondary air jet streams emanating from the burners are controlled so that adjacent burner streams radially expand into contact with one another at a position generally corresponding to that whereat the burner jets become entrained with the tertiary air jets whereby control of combustion of the combustibles within the burner jet streams can be effected in a predictable manner and with avoidance of localized hot spots.

In accordance with still another feature of the method aspects of the invention, the pressurized fluid within the annular heat transfer space can be utilized to provide preheated combustion air to the coal-fired burners. Still further conventional heat exchange mechanisms adjacent the outlet end of the heat track conduit can be utilized to preheat air and or steam prior to being supplied to the heat exchanger tubes in the annular heat transfer space.

Still yet another aspect of the invention simply resides in utilizing the heat track conduit in combination with the rotating, regenerative heat transfer cylinder to provide indirect heat transfer to heat exchange tubes in the annular heat transfer space.

Still yet another aspect of the invention is to provide a high temperature furnace in a coal gasification, electrical power plant using high temperature gas in a Brayton cycle turbine and steam in a Rankine cycle turbine in which the high temperature furnace includes an arcuate heat track conduit defined by inner and outer track walls with the inner track wall having an opening extending there along and the heat track conduit having an inlet and outlet end with coal-fired burners positioned at the inlet end for firing products of combustion through the heat track conduit to the outlet. A cylindrical outer casing wall circumferentially extends a predetermined acurate distance and has circumferential ends terminating generally adjacent to the opening in the inner track wall. A heat transfer cylinder is disposed within the cylindrical outer wall and has a first circumferentially extending surface portion extending through the opening and a second circumferentially extending surface portion generally adjacent a space radially inwardly from the outer cylindrical wall to define an annular heat transfer space therebetween. A plurality of first heat exchanger tubes in the heat transfer space carry steam and a plurality of second heat exchanger tubes in the heat transfer space carry air and a mechanism is provided for rotating the heat transfer cylinder so that the first surface portion thereof heated by the coal-fired burners rotates adjacent to the outer cylindrical wall for sequentially heating the steam and air heat exchange tubes while the second surface portion rotates into the opening to be heated by the coalfired burners.

It is thus one of the principle objects of the invention to provide method and apparatus for effecting high temperature, indirect heat transfer in an industrial furnace or a boiler or a heat exchanger or a power generating plant.

It is another object of the present invention to provide method and apparatus for a coal-fired furnace which has low $NO_x$ emission.

In accordance with the foregoing object, it is a more specific object to provide method and apparatus for a coalfired furnace or boiler in which staged combustion is achieved without localized high temperature $NO_x$ formation areas by utilization of freely expanding entrainment jets.

Yet another object of the invention is to provide in a coal-fired furnace or boiler a burner arrangement which is transparent to the heat transfer surface thus avoiding high temperatures which could otherwise produce $NO_x$.

Still yet another object of the invention is to provide in a high temperature coal-fired boiler or furnace, conventional, alloy steel heat exchange tubes which are not exposed to burner ash and are thus long lasting.

Still yet another object of the invention is to provide a coal-fired high temperature furnace or boiler which achieves any one or more or combination thereof of the following:

a.) Separation of high temperature combustion products from exposed metallic heat transfer surfaces to eliminate deposition of soot and particles and to eliminate corrosion of high temperature alloy heat transfer surfaces;

b.) Combustion chamber and burner design which require relatively small number of coal burners;

c.) Low NOx emission despite high combustion air preheat temperatures;

d.) Use of non-metallic, low expansion ceramic/refractory surfaces as primary heat transfer media in the coal combustion sections;

e.) Use of radiation heat transfer surfaces to limit surface area and control critical heat transfer rates and alloy surface temperatures;

f.) Optimum utilization of expensive high temperature metal alloy;

g.) Reduction of auxiliary natural gas use through higher air preheat temperatures;

h.) Use of optimum heat transfer modes (radiation vs. convection) throughout the system;

i.) Use of dry sorbents and low velocity gas streams to control $SO_x$ emissions;

j.) Use of dry sorbent particles to enhance radiated heat transfer;

k.) Use of modular design.

These and other objects of the present invention will become apparent to those skilled in the art upon a reading of the detailed description of the invention set forth below taken together with the drawings which will be described in the next section.

BRIEF DESCRIPTION OF THE DRAWINGS

The invention may take physical form in certain parts and arrangements of parts, a preferred embodiment of which will be described in detail and illustrated in the accompanying drawings which form a part hereof and wherein:

FIG. 2 is a schematic, cross sectional view of the furnace of the present invention taken through its center;

FIG. 3 is a longitudinally-sectioned, schematic view of a portion of the furnace of the present invention taken along line 3—3 of FIG. 2;

FIG. 4 is a longitudinally-sectioned, schematic end view of the furnace of the present invention taken along line 4—4 of FIG. 2.

DETAILED DESCRIPTION OF THE PREFERRED EMBODIMENT

Figure 1:
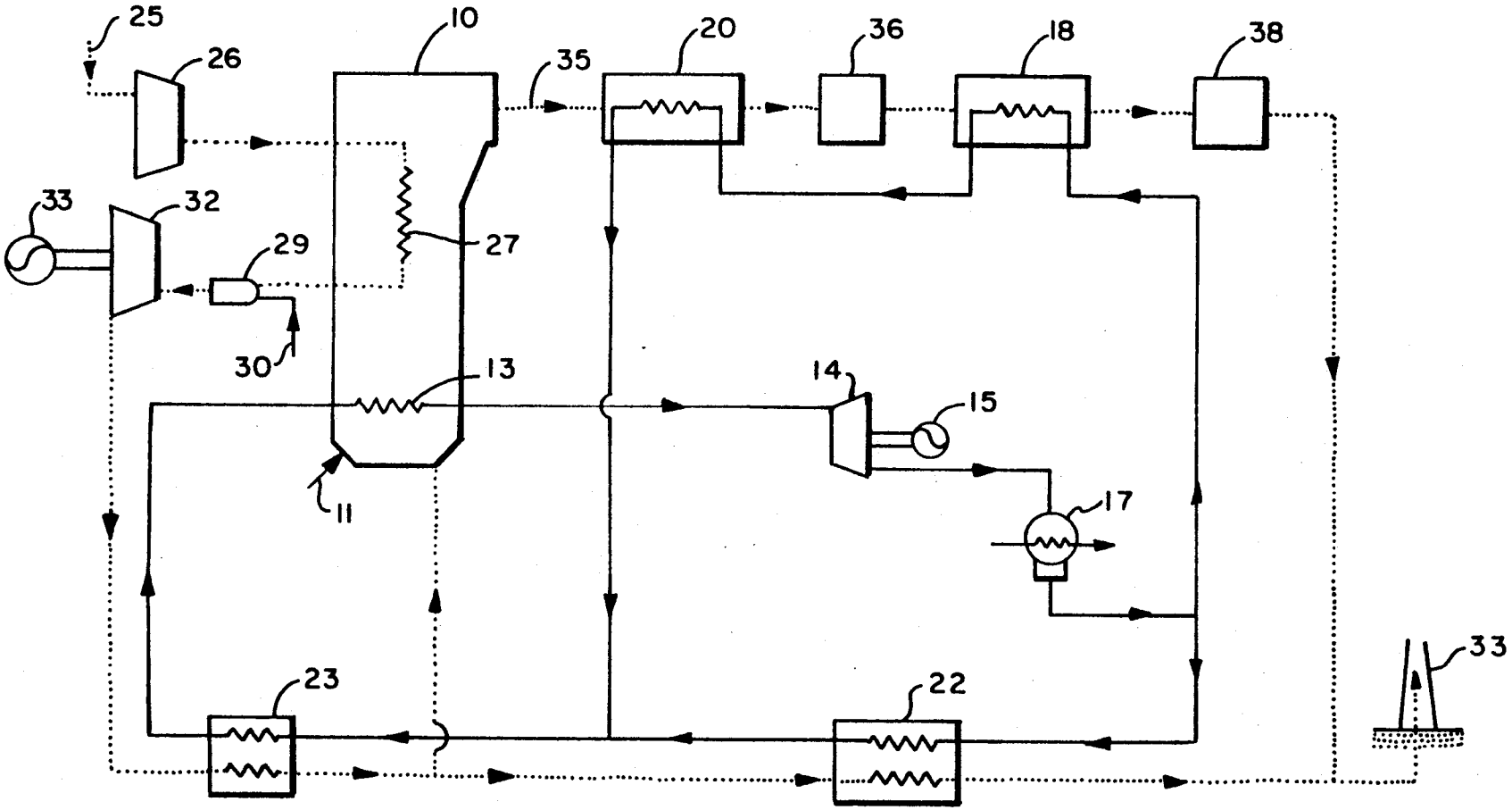
FIG. 1 is a flow schematic diagram of a power generating plant and is prior art.

Referring now to the drawings wherein the showings are for the purpose of illustrating a preferred embodiment of the present invention only and not for the purposes of limiting the same, there is shown in FIG. 1 a flow diagram of an electrical power generating plant in which solid flow lines represent water or steam flow and dot or dash lines indicate air or flue gas flow. In the flow schematic of FIG. 1, a high temperature furnace 10 i.e., the present invention, is fired by coal indicated by reference numeral 11 to heat water as at 13 into superheated steam. This steam is used in a conventional Rankine steam cycle. More specifically, the super heated steam leaving high temperature furnace 10 drives a steam turbine 14 which in turn powers an electrical generator 15. After leaving steam turbine 14, the steam is condensed into water at condenser 17. The super heated steam is heated to a temperature of above 1150° F. for steam turbine 14. As shown in the flow diagram of FIG. 1 the water after leaving condenser 17 is split into two routes as it returns in a closed loop to high temperature furnace 10. In the upper route shown in FIG. 1, the water passes through a low temperature economizer 18 and then through an economizer boiler 20 before being combined with the water passing through the lower route. Water in the lower route passes through an economizer boiler 22 and the combined water then passes through a boiler and superheater 23 which raises the temperature of the water somewhat prior to again entering high temperature furnace 10.

The Brayton cycle schematically illustrated in FIG. 1 uses a source of fresh incoming air designated at reference numeral 25 which is compressed in a compressor 26 and heated in high temperature furnace 10 as indicated by reference numeral 27. The air is heated in high temperature furnace 10 to temperatures of anywhere between about 1800° F. to about 2300° F. In the schematic illustrated in FIG. 1, the heated air (or flue gas) leaving high temperature furnace 10 is then further heated by a burner 29 which is contemplated to be fired from a source of natural gas indicated by reference numeral 30. The air by means of burner 29 is thus boosted to a still higher temperature of somewhere around 2300° F. which heated air then drives a Brayton gas turbine ready which in turn drives an electrical generator 33. Air leaving Brayton turbine 33 then passes through boiler superheater 23 and economizer boiler 22 establishing heat transfer therewith before being exhausted to stack 33.

The flue gas exhaust indicated by line 35 sequentially passes through economizer boiler 20, a bag house 36 which removes particulates from the flue stream and the exhaust flue gas, low temperature economizer 18 and finally a wet gas scrubber 38 for removing sulphur and other emissions before being vented to stack 33.

As noted above, the flow schematic does not form the invention but merely illustrates a particular application of the present invention.

Referring now to FIGS. 2, 3 and 4 high temperature furnace includes a heat track conduit 40 defined by a ceramic inner wall 41, a ceramic outer wall 42, a ceramic top wall 43 and a ceramic bottom wall 44 with walls 41–44 configured in such a wall to generally make heat track conduit 40 arcuate in the shape best shown in FIG. 2 for reasons which will be explained hereafter. Heat track conduit has a closed end defined by end wall 46 and an open end 47. Inner heat track conduit wall 41 has a longitudinally extending opening 49 formed therein and a ceramic heat transfer cylinder 50 is positioned so that a portion of its surface extends through inner wall opening 49. More specifically, outer wall 42 is arcuate over that portion of its length which is generally adjacent to the surface portion of heat transfer cylinder 50 which extends through inner wall opening 49. In fact, the arcuate portion of outer wall 42 is determined by an arc struck from the center 52 of heat transfer cylinder 50 so that that portion of heat transfer cylinder 50 which extends through inner wall opening 49 is simply displaced radially-inwardly from the arcuate portion of outer wall 42. The illustrated configuration is preferred, however, depending upon the jet entrainment desired, for reasons which will be explained hereafter, the shape of heat track conduit 40 adjacent heat transfer cylinder 50 may vary.

Heat transfer cylinder 50 is shown as a hollow ceramic construction to emphasize the fact that heat transfer cylinder 50 is basically a longitudinally extending arcuate wall. However, heat transfer cylinder 50 can be formed as a solid, refractory member. Ceramic refractory is the preferred construction for both heat track conduit 60 and heat, cylinder 50 such as a silicon carbide, siconex (available from 3M) etc.

The axial ends of heat transfer cylinder 50 are sealed to top and bottom walls 43, 44 by means of a sand or water seal type arrangement (not shown) conventionally used in the steel mill art for sealing coil annealing covers to a base member. Other lip type seal arrangements will suggest themselves to those skilled in the art. The axial ends of heat transfer cylinder 50 are desired to be sealed from heat track conduit 40 to prevent any atmosphere within heat track conduit 40 from bleeding past heat transfer cylinder 50 over that portion of heat transfer cylinder 50 which extends through inner wall opening 49. A conventional drive mechanism (not shown) is provided to rotate heat transfer cylinder 50 such as in the direction of reference numeral arrow 54 so that at any given time a predetermined arcuate or circumferential segment of heat transfer cylinder 50 extends through inner wall opening 49, thus forming part of heat track conduit 40, while the remainder or the second portion of the surface of heat transfer cylinder 50 is outside of the inner wall opening 49. Thus, as the drive mechanism rotates heat transfer cylinder 50 in the direction of arrow 54 either continuously, intermittently or a combination thereof, a portion of the surface of heat transfer cylinder 50 is rotated into and out of contact with inner wall opening 49.

Extending from or adjacent to inner wall opening 49 and either as a separate element of or, as shown, contiguous with inner wall 51, is an outer cylindrical casing section 60. Outer casing section 60 circumscribes that portion of heat transfer cylinder 50 which does not extend into inner wall opening 49 and is spaced radially-outwardly from heat transfer cylinder 50 to define an annular heat transfer space 62 therebetween. In the preferred embodiment of the invention disclosed in FIG. 2 annular heat transfer space 62 may be subdivided into two portions by a dividing wall number 63 extending from the inside surface of outer casing section 60 radially-inwardly towards heat transfer cylinder 50. In one portion of the annular heat transfer space 62 is positioned longitudinally extending steam heat exchange tubes 65 while in the other portion of heat transfer space 62 extending on the other side of dividing wall number 63 is positioned air heat exchange tubes 66. Heat exchange tubes are conventional. Steam heat exchange tubes can be constructed of 306 stainless steel while air heat exchange tubes 66 would be constructed of higher alloys such as Haynes 230, Haynes 556, Alloy X, Rolled Alloy 330, 333 etc. In the preferred embodiment which is designed for application to the steam generating plan of FIG. 1, steam heat exchange tubes 65 extend over an arcuate or circumferentially extending distance of annular heat transfer space 62 equal to that shown by reference numeral 68 in FIG. 2 (approximately 40°) while air heat exchange tubes 66 circumferentially extend over an arcuate segment of annular heat transfer space 62 indicated by reference numeral 69 in FIG. 2 (approximately 110°). It is of course to be appreciated by those skilled in the art that annual heat transfer space 62 can be subdivided into any number of segments or can simply comprise one segment and that various types of heat exchange devices can be inserted into heat transfer space 62.

It is to be understood that in the preferred embodiment heat exchange tubes 65, 66 comprise conventional alloy tubes which longitudinally extend the length of heat transfer cylinder 50 and are provided with a manifold at their top and bottom ends (not shown) in which the fluid, air or steam, to be placed into heat transfer contact therewith is supplied and exhausted from such manifolds. More specifically, for steam arcuate segment 68 a steam inlet 71 is provided at the bottom manifold and a steam outlet 72 is provided at the top manifold. Similarly, turbine air arcuate segment 69 likewise has a turbine air inlet 74 provided at the top manifold and a turbine air outlet 75 provided at the bottom manifold.

In addition, there can also be provided for turbine air arcuate segment 69, a combustion air inlet 70 and a combustion air outlet 73 and in which combustion air is preheated by circulating in annular heat transfer space 62 between combustion air inlet and outlet 70, 73. This increases heat transfer by convection to air heat exchange tubes 66 while also preheating combustion air 69. Similarly, there can also be provided for steam arcuate segment 68 an inert gas inlet 77 and an inert gas outlet 79 for circulating in annular heat transfer space 62 between inert gas inlet and outlet 77, 79 an inert or flue gas to cause heat transfer by convection to steam heat exchange tubes 65 in steam gas segment 68. Dividing wall 63 prevents, in combination with placement of inlet and outlets 70, 73, 77, 79 as shown, communication between combustion air and inert gas. Additionally, conduits (not shown) which connect inlets 70, 77 and outlets 73, 79 have baffles and/or pumps (not shown) attached thereto for controlling pressure and flow of combustion air and inert gas to annular heat transfer space 62.

The longitudinally extending edge of inner wall opening 49 formed in inner wall 41 is, as best shown in FIG. 2 arcuately shaped as at 78 and is spaced closely adjacent surface cylindrical heat transfer cylinder 52 and functions as an orifice between annular heat transfer space 66 and heat track conduit 40. Thus by controlling mass flow of combustion air between inlet and outlet 70, 73 and inert gas inlet and outlet 77, 79 annular heat transfer space 62 can be maintained at a pressure which is greater than the pressure of the burner's products of combustion in heat track conduit 40 and orificing edges 78 function to prevent fluid communication from heat track conduit 40 to annular heat transfer space 62. In fact, it is contemplated that the flow of the gases within annular heat transfer space 62 will be somewhat quiescent. In other words, the pressure differential between annular heat transfer space 62 and heat track conduit 40 will be very slight so that only a nominal, if any, amount of gas escapes through orifices 78 with the result that the gas in annular heat transfer space 62 is in somewhat a quiescent state. On the other hand, if high mass flow is desired to occur in annular heat transfer space 62, then it is specifically contemplated that combustion air can be placed in turbine air heat exchange arcuate segment 69 and an inert gas such as flue gas used in steam heat exchange arcuate segment 65 whereby any bleed of the combustion air from arcuate segment 69 into heat track conduit 40 will occur where staged combustion is complete and thus not adversely impacts on $NO_x$ formation. Still further it is possible to eliminate any gas pressurization in annular heat transfer space 62. Some heat track conduit gas will escape into annular heat transfer space 62, but the effects may not be significantly adverse. Additionally, a longitudinally extending scrapper blade similar to that which is conventionally used on rotary pyrolizing furnaces can be applied (not shown) in heat track conduit 40 adjacent to one of the edge orifices 78 for scrapping off any ash which might accumulate on the surface of heat transfer cylinder 50.

To achieve maximum heat utilization from high temperature furnace 10 a first preheat bank or bundle of longitudinally extending heat exchange tubes 80 is provided adjacent outlet 47 and downstream from the first bank of heat exchanger tubes 80 is a second bank or bundle 82 of longitudinally extending heat exchanger tubes. Each bank 80, 82 is schematically shown in FIG. 2 and it will be understood by those skilled in the art that the heat exchanger tubes are positioned in circular arrays with their ends connected to manifolds (not shown) and with each manifold connected to an inlet or an outlet. In the arrangement shown in FIG. 2 first heat exchanger bank 80 has an inlet 84 connected to the top manifold and an outlet 85 connected to the bottom manifold so that the flow of turbine air is from the top to the bottom in first heat exchange bank 80. The second heat exchange bank 82 has an inlet 87 connected to the bottom manifold (not shown) and an outlet 88 connected to the top manifold (not shown) so that the flow of turbine air is from bottom to top in second heat exchange bank 82. In the preferred embodiment, turbine air to drive the Brayton turbine 32 is inputted to first heat exchange preheat bank inlet 84 at a temperature of about 650° F. (having been heated from ambient from any of the other heat exchanger shown in FIG. 1) and it is raised in temperature to about 800° F. when it leaves first heat exchanger bank outlet 85. The turbine air is then inputted to second heat exchange bank inlet 87 and heated in second heat exchange bank 82 to a temperature of about 1200° F. when it leaves second heat exchange bank outlet 88. The preheated turbine air is then inputted into turbine air inlet 74 of high temperature furnace 10 and it is then heated to a minimum temperature of 1800° F. (theoretical calculations indicate 2300° F.) when it leaves gas outlet 75 to gas burner 29 in FIG. 1 for further heating to the desired temperature for use in Brayton turbine 32.

In end wall 46 of heat track conduit 40 there is positioned a plurality of coal-fired burners 90. Coal fired burners 90 are longitudinally spaced one on top of the other as best shown in FIGS. 3 and 4 and extend the length of heat track conduit 40 which in turn is equal to the length of heat transfer cylinder 50. Coal fired burners 90 which are to be used in the subject invention will not be of the typical, coal-fired boiler burner design but will be cyclone burners or cement kiln burners which are conventionally available from burner suppliers such as Cyclone, Maxon, Eclipse etc. Such burners use a swirling, recirculating flow pattern to develop short, intense flame profiles.

As schematically shown in the drawings, each coal-fired burner will be supplied with a source of primary air, preferably preheated, indicated by reference numeral 91 and a source of pulverized fuel indicated by reference numeral 92. In addition, a source of preheated secondary air indicated by reference numeral 94 will also be supplied coal-fired burners 90. All preheated air can be supplied from a splitstream leaving 23 or from combustion air outlet 73 of high temperature furnace 10 and is of relatively high temperatures of about 750° F. (Air from high temperature furnace may be diluted to achieve this temperature.) The supply of primary air in 91, pulverized fuel 92, and secondary preheated air 94 is under the control of a conventional microprocessor controller 95 which in turn controls tertiary air 97 which is inputted to a tertiary air jet 98 in outer wall 42 of heat track conduit 40. Controller 95 also controls a source of completion air 99 which is inputted to a completion air jet 100 which is similarly positioned in outer wall 42 of heat track conduit 40 downstream from tertiary air jet 98. Also controller 95 controls rotation of heat transfer cylinder 50.

Reference should be had to my U.S. Pat. No. 5,052,921 for a discussion of the formation of $NO_x$ compounds in industrial burners. Without repeating that discussion it is known that if temperatures of the gaseous products of combustion emanating from the burner, any burner, is kept below a fixed temperature, $NO_x$ compounds will tend not to form. The upper limit of that temperature is about 3000° F. although recent investigations indicate that such temperature might be somewhat less and could be about 2800° F. In other words, the adiabatic flame temperature of the burner has to be controlled to be less than 3000° F. and preferably less than 2800° F. Next from the teachings of my prior patent, it is known that if the burner is fired substoichiometrically and preferably at a very rich value, the burner will produce not only the normal products of combustion, but also unburned or uncombusted combustibles such as $H_2$ and CO and the presence of the combustibles interact, both kinetically and in the steady state condition, with other chemical reactions to suppress chemical reactions which otherwise would form $NO_x$ compounds. It is thus known to use staged combustion to react combustibles with completion air and numerous approaches exist in the prior art to accomplish this without producing high temperatures whereat $NO_x$ formation will occur. This invention utilizes a particularly unique approach especially adapted for the unique high temperature furnace 10.

More specifically, as best shown in FIG. 2, firing track conduit 40 is shaped to have a straight portion adjacent end wall 46 and also a straight leg portion adjacent outlet end 47 with the arcuate portion of firing track conduit 40 therebetween. Cement kiln burners 90 which are positioned in end wall 46 have a long flame and the length of this flame is in the order of the straight length portion of heat track conduit 40 adjacent end wall 46 from which burners 90 fire. Because of the configuration of heat track conduit in combination with the long flame length of burners 90 the flame is somewhat transparent to that portion of the surface of heat transfer cylinder 50 which protrudes through inner wall opening 49. In other words, the burner flame is transparent to heat transfer cylinder 50. This means that the burner flame will radiate heat to the surface of heat transfer cylinder 50 and thus, hot spots resulting from radiation heat (a phenomena commonly recognized and known in the industrial furnace heat treat art) is avoided and the possibility then of raising to a high temperature the burner products of combustion in a localized area which will cause $NO_x$ to form is avoided.

It is to be understood that the primary air 91 and pulverized coal 92 supplied to burners 90 is regulated by controller 91 to have a relatively low air to fuel ratio, 7 to 1 and preferably 6 to 1 or less so that the products of combustion produced by burners 90 are high in combustibles, CO and $H_2$. End wall 46 through which burners 90 fire the substoichiometric mixture of air and fuel is modified to have an orifice 101 associated with each burner 90 and surrounding the burner products of combustion stream. (As used herein, products of combustion include not only the fully reacted chemical compounds resulting from combustion of fuel and air but also the unreacted combustibles such as $H_2$ and CO.) Through orifice 101 secondary preheated air 94 is provided so that a free-standing jet stream shown by dot lines 102 in FIG. 2 is produced. This is a free-standing, right angle jet cone 102 which carries the combustibles and products of combustion along therewith and by entrainment causes gradual mixing of the combustibles with secondary air forming free-standing jet stream 102. Specifically, the shape (velocity, speed, mass flow etc.) is controlled so that jet stream 102 expands into tangential wiping contact with the outer surface of heat transfer cylinder 50 extending through inner wall opening 49 to effect good heat transfer therebetween while at the same time minimizing turbulent mixing which could otherwise occur if the jet directly impinged heat transfer cylinder 50. Turbulent mixing at heat transfer cylinder 50 would produce "hot spots" at its surface. More particularly, as shown in FIG. 4 the expansion of the jet cones in the longitudinal or vertical direction is also controlled. At the point where the secondary air jet streams 102 are about to, expand into one another, they become entrained by tertiary air jet streams shown by dot lines 104 which are likewise right angle, free-standing cone ets. Preferably there is a plurality of tertiary air jets 98 corresponding to the number of burners 90. The tertiary air jet streams 104 entrain secondary air jet streams 102 and the products of combustion emanating from burners 90 to change their direction in heat track conduit 40. While some turbulence is caused by the jets colliding with one another, the jets are not striking a surface whereat the turbulence or circulation will cause "dead spots" or lees leading to temperature rises or spikes where $NO_x$ will readily form. The entrainment and the mixing between the combustibles and the air in the jet continues. At the same time, tertiary air jet streams 104 are directed tangentially to impinge the surface of heat transfer cylinder 50 downstream of the impingement contact of secondary air jet streams 102. Finally, tertiary air jet streams 104 are in turn entrained within completion air jet streams 106 emanating from completion air jet nozzles 100 which are likewise longitudinally staggered one on top of the other in the same manner in which burners 90 are positioned. Again, completion air jets 106 tangentially wipe the surface of heat transfer cylinder 50 while causing the products of combustion to complete their right angle turn. The cumulative effect of jet streams 102, 104, 106 is to provide a very long entrainment path assuring thorough mixing of the combustibles over a long entrainment path with precise amounts of air to prevent temperature spiking above the $NO_x$ formation temperatures. At the same time, the jets are providing very efficient heat transfer to that surface of heat transfer cylinder 50 which extends through inner wall opening 49. This heat transfer in addition to the radiation of heat from outer heat track conduit wall 42 (which is less than 3000° F.) provides a very fast transfer of heat to heat transfer cylinder 50. It should be noted that heat track conduit 40 is essentially rectangular in configuration and the spacing between inner and outer walls is generally constant. However depending on jet position and the desired entrainment with tertiary and completion air, the cross-sectional configuration can change as well as the arcuate shape of the heat track.

As heat transfer cylinder 50 rotates, that surface portion which has been heated from heat track conduit 40 gradually gives up its heat to heat exchange tubes 65, 66 as the heated surface rotates within outer cylindrical casing 60. The rate of rotation controls the heat transferred from heat transfer cylinder 50 to heat exchange tubes 65, 66. The system is thus regenerative. However, heat is transferred to heat exchange tubes 65, 66 which are sheltered in annular heat transfer space 62 from the products of combustion emanating from burners 90. Thus the heat exchange tubes 65, 66 are indirectly heated from heat transfer cylinder 50 and are not subjected to the ash, carbon and sooty atmosphere which such heat exchange tubes are exposed to in coal-fired boiler applications. This permits the heat exchange tubes to be made of conventional construction even though they are exposed to very high temperatures which significantly lowers their yield and ultimate stress limits. Finally, the furnace is further characterized by being relatively free in formation of $NO_x$ compounds despite its high temperature operation including the use of preheated combustion air.

The high temperature furnace 10 for the combined cycle plant is designed to deliver high pressure air to the Brayton cycle turbine at 2300° F. by using coal as primary fuel and by using a minimum amount of natural gas as secondary fuel. The combustion and air heater design includes features which will minimize formation of $NO_x$ by advanced staged combustion and will control $SO_x$ emissions initially by using wet flue gas desulfurization. A detailed description of the system and its components is given below.

The combined cycle plant consists of high temperature furnace 10 which is a pulverized coal-fired unit where high pressure (169 psia) air is heated from 649° F. to 1800° F. (or higher) and steam from an HRSG (heat recovery steam generator) boiler and superheater is further superheated from 615° F. to 1150° F. The high temperature furnace 10 and key components of all the other parts of the cycle are shown in FIG. 1. A more detailed picture of the proposed wall high temperature furnace 10 is shown in FIGS. 2–4.

The heart of the system is a rotary regenerative heat exchanger in which heat generated by coal combustion is first transferred to a rotating refractory wall. The rotating wall enters a clean chamber where its heat is transferred from the rotating wall by radiation to heat transfer tubes and to Brayton cycle air and steam from a Heat Recovery Steam Generator (HRSG). The rotary wall is made from selected advanced ceramic materials and is heated by several vertically stacked coal flames. It alternately passes from the combustion chamber to the heat transfer chamber. The rotary wall absorbs heat from the combustion gases, transports it mechanically from the dirty coal combustion environment into a clean heat transfer environment, and transfers it from the rotary wall to a series of high temperature alloy tubes.

The alloy tubes consist of two separate banks. The first bank carries steam, the second carries partly preheated air. The furnace section containing the tube banks is completely isolated and is protected from contact with coal combustion products (gases and solids). The resulting benefits are twofold. Neither fouling (ash, soot, carbon etc.) nor corrosive reactions of flue gases (carbon monoxide, hydrogen, and nitrogen), nor interaction between metal surfaces and ash can occur in this isolated section which is kept under a very small over-pressure by purging it with a small flow of preheated combustion air.

By precluding fouling of tube surfaces, heat transfer is improved. By eliminating corrosion (surface and intergranular) of tube walls, smaller service factors can be used in design. (The overall heat transfer can be controlled, producing optimum fluid temperatures with the proposed design.

Two banks of tubes are preferable. As the rotary heat transfer cylinder enters the heating zone, the first bank superheats the steam to 1150° F. and the second bank heats the air to 1800° F. or higher. This arrangement allows the use of substantially elevated regenerator wall temperatures while avoiding overheating of tube material. Improvements in overall heat transfer allow for a more compact design and higher fluid temperatures. After passing by the steam super heating section the rotating wall surface transfers the remaining heat to a series of tubes carrying air which is heated from approximately 1200° F. to 1800° F. or higher at 169 psia. Preheating of the air to 1200° F. takes place in the other two air heat exchangers shown in FIG. 2 which operate at lower temperatures and are in contact with flue products.

The combustion section of the high temperature furnace 10 uses staged combustion of coal to reduce formation of $NO_x$. Staging is accomplished in a different way compared to conventional staged combustion. The entire preheated combustion air is subdivided into four different flows, primary, secondary, tertiary, and completion air. A small amount of cold primary air is used to entrain and transport the pulverized fuel and provide the necessary center jet momentum. Preheated secondary air provides about 60% of the overall stoichiometric air and is supplied to the coal burners. Tertiary and completion air each provide about 20% of the air and are injected further downstream of the burners. The coal combustion at substoichiometric conditions produces a lower flame temperature and generates a highly reducing atmosphere where formation of prompt NO and thermal NO are greatly reduced. These intermediate combustion gases, which form after secondary air combustion, are cooled to a lower temperature by the rotating wall before additional heat is added by injecting tertiary and completion air. The rotating cylinder, therefore, acts as a heat sink between air additions and thus the temperatures of the combustion products and even the flame itself can be maintained below 3000° F. At these lower temperatures, kinetics of $NO_x$ formation is greatly retarded.

For many coals, utilization of preheated air at 750° F. results in melting of ash. Molten ash deposited on the stationary wall of the furnace chamber can be tapped and used to produce granulate or even fibers. It is estimated that a significant portion of the ash can be extracted in liquid form, reducing the load in the downstream bag house. The slag produced under these conditions has always been a marketable product for utilities.

When leaving the regenerative heat transfer section, the flue gases enter a radiation heat exchanger at approximately 2100° F. In this heat exchanger, cycle air compressed by a compressor to 169 psia is heated from approximately 800° F. to 1200° F. Flue gases containing $CO_2$, $H_2O$ and $SO_2$ emit energy in selected spectral bands and can transfer heat to a series of tubes arranged at the circumference of a relatively small (about 16 feet diameter) gas passage. The flue gases cool down and are discharged at approximately 1130° F. The downstream portion of this heat exchanger can be utilized as the reactor for $SO_x$ control with dry sorbent injection. It is designed to produce virtually plug flow conditions and intimate, uniform mixing between properly sized lime and flue gases which will produce high calcium conversion efficiencies. The presence of solid particles offers an additional advantage. These particles will contribute to solid (gray) body radiation which in turn enhances the already high heat transfer from radiating flue gases.

The radiation heat exchanger is followed by a combination radiation/convection heat exchanger in which the compressed Brayton cycle air is heated from 650° F. to 800° F. this heat exchanger design includes a unique arrangement of radiation enhancement surfaces to augment radiation and convection to the tubes carrying the air while maintaining minimum pressure drop on the flue gas side. The flue gases in this section are at temperatures where gas radiation and convection heat transfer play equally important roles. The flue gases are discharged at approximately 770° F. from this heat exchanger. The gas passages and tube arrangement in this heat exchanger must be designed to minimize ash and sorbent deposition on the air tubes in order to maintain relatively high heat transfer rates. A tube cleaning device (e.g. soot blower) must be incorporated.

After leaving the high temperature furnace 10 at approximately 770° F., the flue gases pass through an economizer/boiler where the temperature is reduced to approximately 380° F. by heating steam from approximately 310° F. to 600° F. The flue gases then pass through a baghouse where the particulates are removed. An induced draft fan pumps the flue gas from the baghouse through a low temperature economizer where the temperature is further reduced to 215° F. in heating feedwater to 310° F.

The cooled flue gases are passed through a wet flue gas desulfurization process where the concentration of $SO_x$ in the flue gases is reduced. After this final cleaning step, the flue gases then mix with the cooled air from the gas turbine exhaust and enter a stack at approximately 170° F.

The heated air (at 2300° F.) from high temperature furnace 10 and the in-duct burner powers a gas turbine (approximately 54,000 kW) with the exit air temperature at 1160° F. which passes through an HRSG boiler and superheater, where the temperature is reduced to 750° F. This unit heats the entire steam flow from 598° F. to 615° F as it enters the superheater portion of heat transfer furnace 10.

A portion of the air exiting the HRSG boiler and superheater is directed to heat transfer furnace 10 as preheated combustion air. The remainder flows to an HRSG economizer/boiler where its temperature is further reduced to approximately 200° F. This air then mixes with the flue gases and is discharged from the stack.

The superheated steam from heat transfer furnace 10 powers a steam turbine (approximately 48,500 kW) and discharges to the main condenser. A portion of the feedwater discharge from the condenser is then reheated by the flue gas cycle and a portion by the gas turbine exhaust hot air cycle as noted above. Several features of the high temperature furnace 10 are as follows:

1.) Coal always contains large amounts of particulates in the form of ash. Dependent on coal type this ash can have rather low softening points and may tend to foul high temperature heat transfer surfaces. In conventional boilers heat transfer surface temperatures are rather low and surface fouling results in deposits which can be removed with relative ease with soot blowers. As surface temperatures increase the bond between metal surface and softened ash particles becomes stronger and removal of sintered ash can become very difficult.

Coal derived flue gases also contain severely corrosive gases such as oxides of sulfur ($SO_x$), hydrogen, and carbon monoxide. Interaction between these gases and heat transfer surfaces leads to fouling, chemical attack, erosion, and corrosion. A clean heat transfer environment for the air tubes will result in smaller heat transfer surface requirements, and longer tube life.

In the present invention, combustion products of coal are separated from the high temperature heat transfer surfaces to prevent coal combustion products (gases and solids) from ever contacting the air tubes in the high temperature heat transfer section. This is achieved by utilizing a rotating or rotary wall configuration. In this approach two separate furnace sections are created with one containing the combustion section and the other containing the high pressure air preheater. Heat is first transferred from the flames to all walls of the furnace chamber. One of the walls of the combustion chamber, the inner vertical wall, slowly rotates counter-current to the direction of the flames. (Counter-current rotation occurs in rotary hearth furnaces.) After exposure to the flames and being heated to high temperatures, the inner rotating wall enters into the heat transfer section where heat is transferred from the rotating hot wall to the stationary opposing wall and to the stationary vertically disposed heat transfer tubes.

By physically preventing flue gases or ash from entering the high temperature heat transfer section, heat transfer surfaces can be kept clean. Diffusion of combustion products into the heat transfer section is avoided by supplying a small flow representing a negligible percentage of the combustion air under pressure into the heat transfer section and by continually leaking a small flow of pressurized air into the combustion section.

The proposed configuration allows adjustment and control of the wall temperatures to which the air preheater tubes are exposed. In conventional designs, where the air or steam tubes are exposed to a flame, the temperature may vary considerably from top to bottom and from side to side of each tube. The use of an intermediate surface with relatively high heat capacity offers a "thermal fly wheel" effect which greatly moderates the temperature variations of the main heat transfer surfaces facing the air and steam tubes. Use of relatively narrow passages in which the tubes are located, also restricts the radiation view factors of tubes at any location. This allows all tubes at any one location to see only a relatively narrow temperature band and thus results in limited temperature variations along the length and circumference of the tubes.

The rotational speed of the wheel can be adjusted to control the temperature variation of the wheel surface in the combustion zone as well as the air heating section.

2.) The invention uses pulverized coal and injects it into a set of vertically stacked burners. Typically five burners will be used for a full sized (100 MW) installation and will fire coaxially into an elongated combustion space with hot walls. These burners are operated at substoichiometric air/fuel ratios and are fired into a high temperature recirculation zone. The coal combustion is completed by injecting additional air in at least two downstream locations. It is expected that with the use of preheated compressed air (up to 750° F.) and the presence of a high combustion chamber temperatures, in the order of 2500° F., relatively high combustion intensity and flame stability can be achieved. Experience with similar burner designs indicates that with the use of proper air and fuel injection methods, by controlling mixing and using auxiliary air injection it is possible to control the heat release rates, control the flame length and maintain temperature within a predictable range along the flame length. The combustion chamber temperature can still be maintained above the ash fusion temperature to melt and remove part of the liquid ash in the form of slag.

The combustion chamber is designed such that close to the burners, heat is transferred mainly by radiation from the flame directly to the enclosing walls which allows faster cooling of flame gases. Optical interference with other flames, as conventionally experienced in boilers, is avoided. Reduction of flame temperatures prevents formation of large amounts of $NO_x$ in the flame zone. In the downstream sections of heat track conduit 40, temperatures of the combustion gases are reduced sufficiently so that a conventional convective boiler section can be used to remove the remainder of the lower temperature heat.

3.) In typical coal burning applications large amounts of nitrogen oxides are formed. Efforts to improve cycle efficiency need to resort to high combustion air preheat temperatures which tend to further accelerate $NO_x$ formation and emissions. Research has shown that modification in the combustion process can reduce $NO_x$ formation. These modifications consist of reducing maximum flame temperatures and of providing reducing agents at lower flue gas temperatures. However, present boiler designs are not suited to utilizing this effective $NO_x$ control concept. Optical depth of typically employed combustion volumes are too large for effective maximum flame temperature control and normally employed tube wall alloys are sensitive to corrosion by carburizing and reducing gases.

Thermodynamic predictions show very low $NO_x$ formation at reduced flame temperatures and high concentrations of reducing species in the form of hydrogen, carbon monoxide, and unburned char. Published kinetic models are not sophisticated enough to show $NO_x$ formation rates in the presence of unburned volatiles and char particles. The sectionalized completion burning of the proposed furnace with its maximum temperature control and its favorable reducing flame conditions will produce significantly reduced $NO_x$ emissions, well below 50 ppm in the low temperature convection section of the high temperature furnace 10.

4.) The primary heat transfer surface in the combustion chamber is a high performance ceramic which receives heat from the combustion chamber. The current state of the art in high performance ceramic or refractory materials can offer materials which are virtually free from thermal expansion in the temperature range of 1000 to 3000° F. Most of these materials are practically nonreactive with alkaline materials present in liquid or solid ash or other corrosive gases. These ceramic materials can be heated to temperature levels in excess of 3000° F. for prolonged times even under cyclic conditions.

(5.) Heat transfer in high temperature furnace 10 occurs by two separate processes. At high temperatures, radiation is dominant; at lower temperatures, forced convection is the major heat transfer mode. High temperature furnace 10 is responsive to these process conditions and uses a variety of heat transfer arrangements to produce maximum heat fluxes at declining temperature levels.

In the high temperature air heating and steam superheating sections, heat transfer is by radiation from the rotary wall which is sequentially heated and cooled as its temperatures on the surface and inside the wall follow a sinusoidal pattern. Temperature changes are large on the exposed surfaces but become successively smaller further inside the wall as a result of the refractories thermal conductivity. Calculations show that rather moderate rotational speeds can indeed transport the specified amounts of heat from the combustion section to the heat transfer section while maintaining relatively small transient temperature differentials and moderate temperatures of the ceramic material.

Use of solid ceramic materials at temperature levels of approximately 2500° F. produce very high heat transfer coefficients and resulting heat fluxes to the metallic tubes which carry either compressed air or high pressure steam. In this section the air is heated from about 1200° F. to 1800° F.

The steam superheating section where the steam is heated from 615° F. to 1150° F. is located in the front part of the high temperature heating zone and it is exposed to the highest cylinder wall temperatures. The air heating section is located "down stream" in the wheel rotation and sees lower temperature compared to that in the steam section.

With the use of radiation as a primary mode of heat transfer to the outside of the tube surfaces, it is possible to obtain very high heat fluxes while maintaining moderate temperature differentials between the metallic alloy tubes and the rotary wall. For example, in the air heating section it is possible to get heat transfer rates in excess of 25,000 Btu/hr-ft$^2$ which is much higher than fluxes achieved in conventional gas to gas heat exchangers. The rotational speed of the rotary wheel can be adjusted to control the heat transfer rates in the air heating and combustion section.

6.) The heat transfer tubes must be constructed from high temperature alloys. Present alloy technology makes it possible to operate smaller diameter air tubes at air preheat temperatures of 1800° F. and air pressures of 165 psia. On the inside of the tubes, the high pressure air side, the transfer coefficients are elevated due to the improved property values. On the outside of the tubes the high temperatures of the traveling wall create very high radiation fluxes. Because heat fluxes are high on both sides of the alloy tube wall, and because tube surfaces can be kept clean with the rotary wall concept, the overall heat transfer surface requirements can be kept relatively small.

7.) Placement of tubes in a clean environment offers an additional opportunity of heating the compressed air to higher than 1800° F. temperatures. Most of the high temperature alloys can be used at higher temperatures when their use is in a clean oxidizing air atmosphere as opposed to reducing or sulfurous atmospheres. This advantage offers a possibility of heating compressed air by an additional 200° F. to 300° F. to a final temperature as high as 2000° F. or even 2100° F. in high temperature furnace 10.

Use of higher air temperatures from high temperature furnace 10 can in turn reduce the use of natural gas or other clean fuels by 40–60% and can reduce the cost of power generation significantly.

8.) The preheating of air from 650° F. to 1200° F. is achieved in two separate heat transfer sections. In the first section where the air is heated from approximately 800° F. to 1200° F. the gas radiation from products of combustion is used. In this section the gas temperatures are at a level where gas radiation from $CO_2$ and water vapor is higher than that from forced convection. If dry sorbent injection is used, the fine solid sorbent particles will contribute to radiative heat transfer. Combination of gas and solid particle radiation offers large heat transfer coefficients which are in the same range as the air side heat transfer coefficients.

At lower air temperatures, below 800° F., the solid and gas radiation becomes smaller but it is possible to design a unit in which reradiation surfaces can be used to enhance and complement gas side radiation. The proposed design includes reradiation surfaces in the presence of moderately high convection to minimize the heat transfer surface area and thus the number of tubes required in this section.

9.) Calcium compounds are used to absorb $SO_x$ from the gas phase. Indications have been that wet adsorption is more efficient in calcium conversion than dry absorption. Explanations for this increased efficiency are not convincing. It appears that improper mixing of dry sorbent, too short residence times, and improper reaction temperature ranges can be made responsible for the observed differences in calcium conversion efficiency. Production of dry waste products will obviously make disposal much simpler and especially opens the possibility for partial recycling and thermal regeneration of the dry spent sorbent. The dry sorbent, when injected into higher temperature gases, will also increase the gray radiation compound in heat transfer.

10.) Solid particles are in intimate contact with the gas atmosphere and small particles are virtually at the same temperature as the surrounding gas. The solid particles in turn give off thermal radiation which greatly enhances radiative heat transfer from a sufficiently large gas mass to surrounding heat transfer surfaces. Injection of solid particles into intermediate temperature gases will, therefore, increase heat transfer on the flue gas side.

11.) Many of the components of the high temperature furnace 10 system can be modularized for smaller overall plant capacities. Other components of the plant are available as off-the-shelf items in smaller sizes (for example gas turbines). The high temperature furnace 10 can be conveniently divided into three major modules. They are: the main coal combustion and high temperature air heating section; the medium temperature gas radiation section; and the low temperature convection/-radiation section. Major components for these sections can be prefabricated and assembled at the plant site for improved quality control and reduced cost.

The invention has been described with reference to a preferred embodiment. It is obvious that many alterations and modifications will occur to those skilled in the art upon reading and understanding the invention. It is intended to include all such modifications and alterations, insofar as they came within the scope of the invention.

Having thus defined the invention, it is claimed:

1. A method for effecting high temperature heat transfer in an industrial furnace system having a heat track conduit with an opening in its inner wall; a heat transfer cylinder positioned relative to said heat track conduit so that a portion of its cylindrical surface extends through said opening; a cylindrical furnace casing wall extending about that portion of said heat transfer cylinder which does not extend into said opening to define an annular heat transfer space between said casing wall and said heat transfer cylinder, a plurality of heat exchange tubes in said annular space; said method comprising the steps of:

a) providing industrial burners in said heat track conduit and firing said burners to produce products of combustion at high temperature;

b) heating that portion of the cylindrical surface of said heat transfer cylinder which extends into said opening from said burner's products of combustion;

c) rotating said heat transfer cylinder so that the heated cylindrical surface portion resulting from step (b) is rotated into said heat transfer space;

d) heating said heat exchange tubes in said annular space by said heated cylindrical surface portion of said heat transfer cylinder while simultaneously cooling said cylindrical portion when heat is transferred to said heat exchange tubes; and e) rotating said cylindrical surface portion when cooled by heat transfer to said heat exchange tubes back into said opening for reheating by said burner products of combustion whereby a continuous, regenerative furnace system is provided for indirectly heating fluid in said heat exchange tubes.

2. The method of claim 1 wherein said heat transfer cylinder is rotated continuously in steps (c) and (e).

3. The method of claim 1 wherein said heat transfer cylinder is rotated intermittently in steps (c) and (e).

4. The method of claim 1 wherein said heat transfer cylinder is positioned relative to said opening to define a pair of relatively narrow slots longitudinally extending between the cylindrical surface of said heat transfer cylinder and said heat track conduit opening; said method including the additional steps of providing an inlet and an outlet opening in fluid communication with said heat transfer space; pressurizing said heat transfer space by providing a fluid flowing at controlled rate from said inlet through said outlet; heating said heat exchange tubes by radiation from the surface of said heat transfer cylinder adjacent said annular heat transfer space and by convection from flow of said fluid within said heat transfer space.

5. The method of claim 4 wherein said pressure of said fluid is controlled at a value higher than the pressure of said products of combustion in said heat track conduit and said slot is sufficiently narrow to function as an orifice at said controlled pressure to prevent said products of combustion from said burner from entering into said annular heat transfer space.

6. The method of claim 5 wherein fuel and combustion air are supplied to said burners for providing said products of combustion, said fluid supplied to said heat transfer space is air and said method includes the additional step of providing preheated air to said burners from an outlet of said annular heat transfer space.

7. The method of claim 1 wherein said industrial burners are fired with pulverized coal as the fuel source and further including the step of controlling the ratio of pulverized coal and combustion air supplied to said burner at a substoichiometric ratio sufficient to produce burner products of combustion which are rich in combustibles $H_2$ and CO, does not exceed 3,000° F.

8. The method of claim 7 wherein said heat track conduit is a longitudinally extending conduit which is generally arcuate in cross-sectional configuration and open at one end downstream of said heat transfer cylinder and closed at its opposite end upstream of said heat transfer cylinder; said method comprising the additional step of firing said burners at controlled pressure to produce a free-standing jet stream of products of combustion which expands radially into heat transfer tangential impingement contact with that cylindrical surface portion of said heat transfer cylinder which extends into said opening thus avoiding substantial turbulence and localized high temperature areas thereat tending to produce $NO_x$ formations.

9. The method of claim 8 including the additional steps of providing a free-standing jet stream of completion air within said heat track conduit downstream of said burner; directing said completion air jet to tangentially impinge a portion of the surface of said heat transfer cylinder extending within said opening and controlling the rate of completion air flow within said jet and the velocity of said jet to permit controlled entrainment of said combustibles and products of combustion thereof such that the temperature of completion air jet stream does not rise above 3,000° F.

10. The method of claim 9 further including the step of providing a second completion air free-standing jet positioned downstream of said first combustion air jet, said second completion air jet freely expanding into tangential contact with that portion of said heat transfer cylinder extending within said opening downstream of the position where said first completion air stream made initial contact with the surface of said heat transfer cylinder whereby the entire surface of said heat transfer cylinder extending within said opening is subjected to tangential, substantially non-turbulent jet impingement for effective heat transfer therewith while said products of combustion of said burners do not rise above 3,000° F. to prevent $NO_x$ formation.

11. The method of claim 10 including the additional step of providing a plurality of coal-fired burners longitudinally spaced along said end wall and in alignment with one another and controlling the jet streams emanating from said burners such that adjacent burner streams radially expand into contact with one another at a position generally corresponding to that whereat said burner jets become entrained with said completion air jets whereby control of combustion of said combustibles within said burner jet streams can be effected in a predictable manner.

12. The method of claim 1 wherein said heat track means has a closed inlet end and an open outlet end, said burners positioned in said closed inlet end and fired so the burner flame does not extend to said heat transfer cylinder surface within said heat track conduit whereby radiation from said flame is effective to heat said heat transfer cylinder surface within said heat track conduit.

* * * * *